US006975286B2

(12) United States Patent
Rhee

(10) Patent No.: US 6,975,286 B2
(45) Date of Patent: Dec. 13, 2005

(54) METHOD FOR AGING PROCESS IN PLASMA DISPLAY PANEL

(75) Inventor: Byung Joon Rhee, Seoul (KR)

(73) Assignee: LG Electronics Inc., Seoul (KR)

( * ) Notice: Subject to any disclaimer, the term of this patent is extended or adjusted under 35 U.S.C. 154(b) by 385 days.

(21) Appl. No.: 10/263,187

(22) Filed: Oct. 3, 2002

(65) Prior Publication Data

US 2003/0142045 A1 Jul. 31, 2003

(30) Foreign Application Priority Data

Jan. 31, 2002 (KR) ..... 2002-5640

(51) Int. Cl.[7] ..... G09G 3/28
(52) U.S. Cl. ..... 345/60; 315/169.4; 445/6
(58) Field of Search ..... 445/6, 24; 345/60–72; 315/169.3–169, 169.4

(56) References Cited

U.S. PATENT DOCUMENTS 3,687,513 A * 8/1972 Holz ..... 445/6
4,818,913 A * 4/1989 Isaka et al. ..... 315/169.3
6,533,630 B1 * 3/2003 Terajima et al. ..... 445/24
6,666,738 B1 * 12/2003 Kado et al. ..... 445/6
6,707,250 B2 * 3/2004 Okano et al. ..... 313/582
6,821,174 B2 * 11/2004 Kaneko et al. ..... 445/6

FOREIGN PATENT DOCUMENTS

JP 03025826 A * 2/1991 ..... 445/24
JP 2002075208 A * 3/2002 ..... H01J 9/44

OTHER PUBLICATIONS

Machine Assisterd Translation of JP2002-75208, Mar. 15, 2002, Hasegawa et al.*
PTO 2005-1500: Translation of JP 03-025826, Feb. 4, 1991, Okajima.*

* cited by examiner

*Primary Examiner*—Kent Chang
*Assistant Examiner*—Leland R. Jorgensen
(74) *Attorney, Agent, or Firm*—Birch, Stewart, Kolasch & Birch, LLP

(57) ABSTRACT

A method for aging process in a PDP which is able to determine an ending time of the aging process comprises the steps of: starting the aging process by supplying source voltage to the PDP; and defining the aging ending time through change of current waveform by monitoring the change of current waveform applied to the panel, and thereby problems such that discharge characteristics of the panel become unstable due to the lack of aging time and phosphor is deteriorated and processing tack-time is reduced due to over-aging can be solved.

10 Claims, 10 Drawing Sheets

METHOD FOR AGING PROCESS IN PLASMA DISPLAY PANEL

BACKGROUND OF THE INVENTION

1. Field of the Invention

The present invention relates to a method for aging process in a plasma display panel, and particularly, to a method for aging process in a plasma display panel which is able to determine an end point of aging process precisely.

2. Description of the Background Art

As information processing systems are developed and distributed, importance of display device as a means for transmitting visual information is being emphasized. A cathode-ray tube (CRT), which is a main kind of the display device, has disadvantages such as a large size, high operational voltage, and generation of distortion. Recently, flat panel display devices such as liquid crystal display (LCD), field emission display (FED), and plasma display panel (PDP) which are able to improve disadvantages of the CRT are developed. In the PDP among those flat panel display devices, ultraviolet ray of 147 nm wavelength generated when inert mixed gas including He and Xe, or Ne and Xe emits a phosphor, and thereby an image is displayed on a panel. The above PDP can be easily made to be thin film, can be over sized, and has a simple structure, therefore, it is easy to fabricate the PDP and the PDP has higher brightness and luminous efficiency. Especially, in a surface discharge AC type PDP, wall charge is accumulated on a surface of an electrode when the inert gas is discharged, and the electrodes are protected from sputtering generated by the discharge, and therefore, the PDP can be driven with a low voltage and has a long life span.

FIG. 1 is a block diagram showing a 3-electrodes surface discharge AC type PDP according to the conventional art. As shown therein, the surface discharge AC type PDP comprises: a lower substrate 107; an upper substrate 101; a barrier rib 104 for separating the lower substrate 107 and the upper substrate 101 parallelly; fluorescent layers 105R, 105G, and 105B formed on surfaces of the barrier ribs 104 and the lower substrate 107 for generating visible lights of red, green, and blue colors by being excited by ultraviolet ray; address electrodes 106A, 106B, . . . 106N formed on the lower substrate 107 for discharging selectively among a plurality of discharging areas; discharge sustain electrodes 108A, 108B, . . . , 108N installed on the upper substrate 101 for discharging with the address electrodes 106A, 106B, . . . , 106N in the discharging area; a passivation layer 103 for preventing damage of dielectric layer, which will be described later, caused by the sputtering generated in plasma discharging and for raising emission efficiency of secondary electrons; and a dielectric layer 102 for restricting the plasma discharge current and accumulating the wall charges during plasma discharging.

The structure of the surface discharge AC type PDP constructed as above will be described in detail as follows.

The upper substrate 101 and the lower substrate 107 are separated from each other parallelly making the barrier rib 104 therebetween, and the mixed gas such as Ne+Xe, He+Xe, and He+Ne+Xe is injected into the discharging area defined by the upper substrate 101, the lower substrate 107, and the barrier rib 104.

The discharge sustain electrodes 108A, 108B, . . . , 108N are constructed as a pair in every plasma discharging channel, and one (108A) of the pair makes counter discharge with the address electrode as responding to scan pulse supplied during address period, and after that, is used as a scan/sustain electrode making a surface discharge with the adjacent discharge sustain electrode 108B as corresponding to sustain pulse supplied in sustain period. Also, another discharge sustain electrode 108B making a pair with the scan/sustain electrode is used as a common sustain electrode for supplying sustain pulse.

The dielectric layer 102 and the passivation layer 103 are laminated on the upper substrate 101 on which the discharge sustain electrodes 108A, 108B, . . . , 108N are formed. The dielectric layer 102 restricts the plasma discharge current, and accumulates the wall charge during the plasma discharging. The passivation layer 103 generally consists of MgO for preventing the damage of dielectric layer caused by the sputtering generated during plasma discharging and for increasing the emission efficiency of the secondary electron.

The barrier ribs 104 for dividing the discharging areas are stretched vertically on the lower substrate 107, and the fluorescent layers 105R, 105G, and 105B for emitting visible lights of red, green, and blue (R, G, B) by being excited by the ultraviolet ray are formed on surfaces of the barrier ribs 104 and of the lower substrate 107.

Fabrication processes of the PDP constructed as above will be described in brief as follows.

The upper substrate 101 and the lower substrate 107 of the PDP are fabricated, and a sealant is applied between the upper substrate 101 and the lower substrate 107. After that, the sealant is baked at high temperature to attach the upper substrate 101 and the lower substrate 107. In addition, in the exhaust/discharge gas injection process, an air exhaust hole (not shown) is connected on the lower substrate 107, and an exhaust pipe (not shown) is connected to the air exhaust hole to maintain a pressure of the discharging area between the upper/lower substrates 101 and 107 to be $10^{-6}$ Torr, after that, the inert gas consisting of Ne, Xe, He, etc. is injected into the discharging area. When the injection of inert gas is completed, the exhaust pipe is tipped-off. At that time, since an end portion of the exhaust pipe is tipped-off if it is heated higher than 800° C., the air exhaust hole on the lower substrate 107 which is opened due to the tip-off is sealed, and the PDP fabrication processes are completed. The PDP fabricated through the above processes has compound layer structure consisting of a thin film layer, a thick film layer, and a gas layer. However, since the discharging conditions are not even in every layers and cells, aging process is performed for a long time for entirely stable discharge.

FIG. 2 is a view showing an aging system of the PDP according to the conventional art roughly. As shown therein, the aging system comprises; an upper substrate 203 and a lower substrate 202; conductive pads 201 and 204 for connecting electrically the upper substrate 203 and the lower substrate 202; and a power supplying unit 205 for supplying electric power to the conductive pads 201 and 204.

The aging process using the above aging system will be described as follows. Left discharge sustain electrodes 108B, . . . , 108N of the upper substrate 203 are all short circuited using the conductive pad 201 under the room temperature (20~25° C.), and the right discharge sustain electrodes 108A and 108M of the upper substrate 203 are all short circuited using the conductive pad 204. Then, the power supplying unit 205 is connected to both pads to supply the electric power, and thereby discharging is made. Herein, the discharging conditions in aging process are controlled according to the supplied amount of charges by the conductive pads 201 and 204, that is, according to electric power, and therefore, the conditions can be controlled by the voltage and current supplied to the conductive pads 201 and 204.

However, the aging processing method according to the conventional art does not have certain bases which are able to determine the aging end time. Various factors such as voltage, brightness, color temperature, etc. are used as the bases for deciding the aging end time so far. However, the above factors can not determine the aging end time precisely. And this will be described in detail as follows.

FIG. 3 is a graph showing properties of brightness, discharge voltage, and color temperature according to the lapse of time when the aging process is performed according to the conventional art. As shown therein, there is no obvious reference for deciding the aging end time among those the discharge voltage, brightness, the color temperature, etc..

Generally, since the voltage has less sensitivity than that of the electric current, there is a limit to determine the point when the discharge characteristics for thin films having thousands of Å thickness can be stabled. That is, since the discharge voltage of the PDP has a tendency to be saturated easily, and therefore if the aging is ended after deciding wrongly that the discharge voltage is stabled before the PDP is stabled actually, the discharge characteristics are not even when the panel is operated, and thereby a wrong discharge may be generated.

Also, since the brightness or the color temperature among above factors is secondary decision factor which can be known after the visible lights are generated, it is difficult to determine the aging ending time precisely. In addition, even if the aging ending time is determined by the brightness or the color temperature, the aging time is increased excessively, and therefore, the phosphor may be deteriorated and a processing tack-time is increased.

Also, the aging time can be varied according to the status of the phosphor or variables in process, and therefore, the aging time can be determined precisely.

SUMMARY OF THE INVENTION

Therefore, an object of the present invention is to provide a method for solving problems such as unstable discharge characteristics of a panel due to lack of aging time in a plasma display panel (PDP), and deterioration of a phosphor and long processing tack-time due to an over-aging.

Also, another object of the present invention is to provide a method which is able to reduce aging ending time using temperature, frequency, size of supply voltage, and factors after deciding aging ending time precisely by monitoring change in current waveform of the panel during aging process.

To achieve these and other advantages and in accordance with the purpose of the present invention, as embodied and broadly described herein, there is provided a method for aging process in a plasma display panel (PDP) comprising a step of starting aging process by supplying source voltage to the PDP; and a step of defining aging ending time through the change on current waveform by monitoring the current waveform applied to the panel.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A method for aging process according to the present invention is able to solve problems such that discharge characteristics are unstable in aging process and a phosphor is deteriorated by over-aging, by detecting waveform of discharge current of a plasma display panel (PDP) with a predetermined time interval and by deciding aging ending time precisely based on waveform change of the discharge current.

Hereinafter, the method for aging process according to the present invention will be described in detail as follows.

Figure 1:
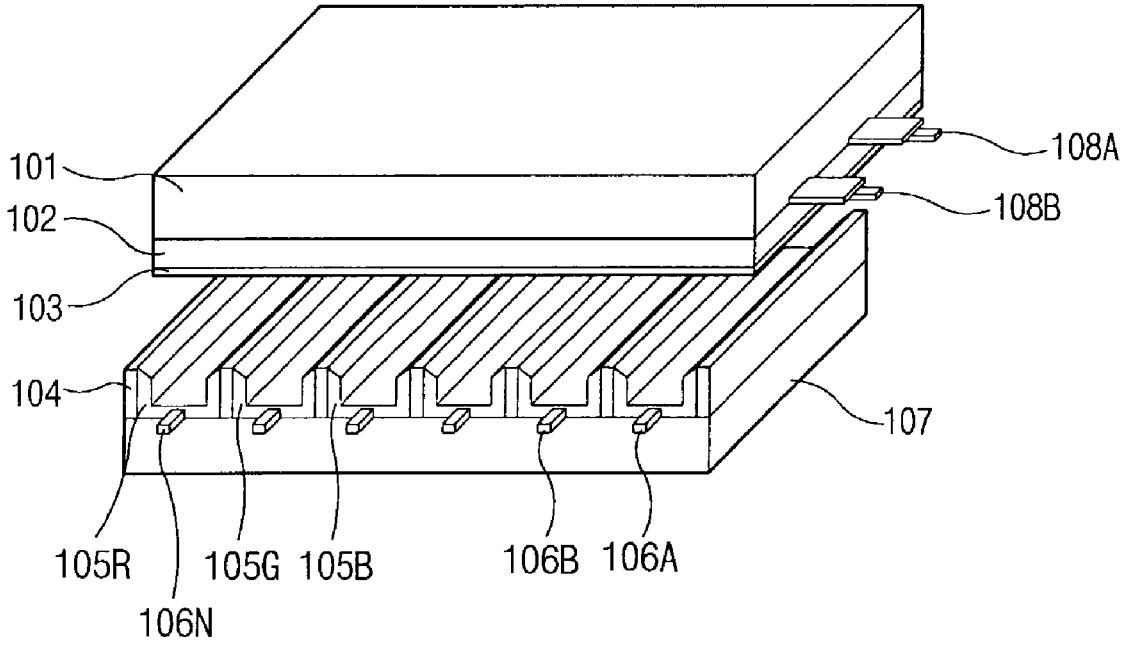
FIG.1 CONVENTIONAL ART
FIG. 1 is a block diagram showing a 3-electrodes surface discharge AC type plasma display panel according to the conventional art.
Figure 2:
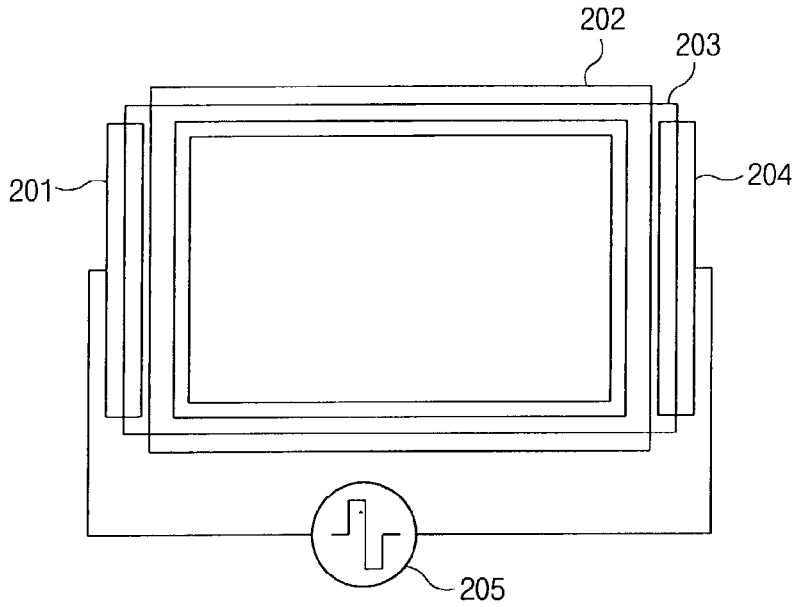
FIG.2 CONVENTIONAL ART
FIG. 2 is a view roughly showing an aging system of the PDP according to the conventional art.
Figure 3:
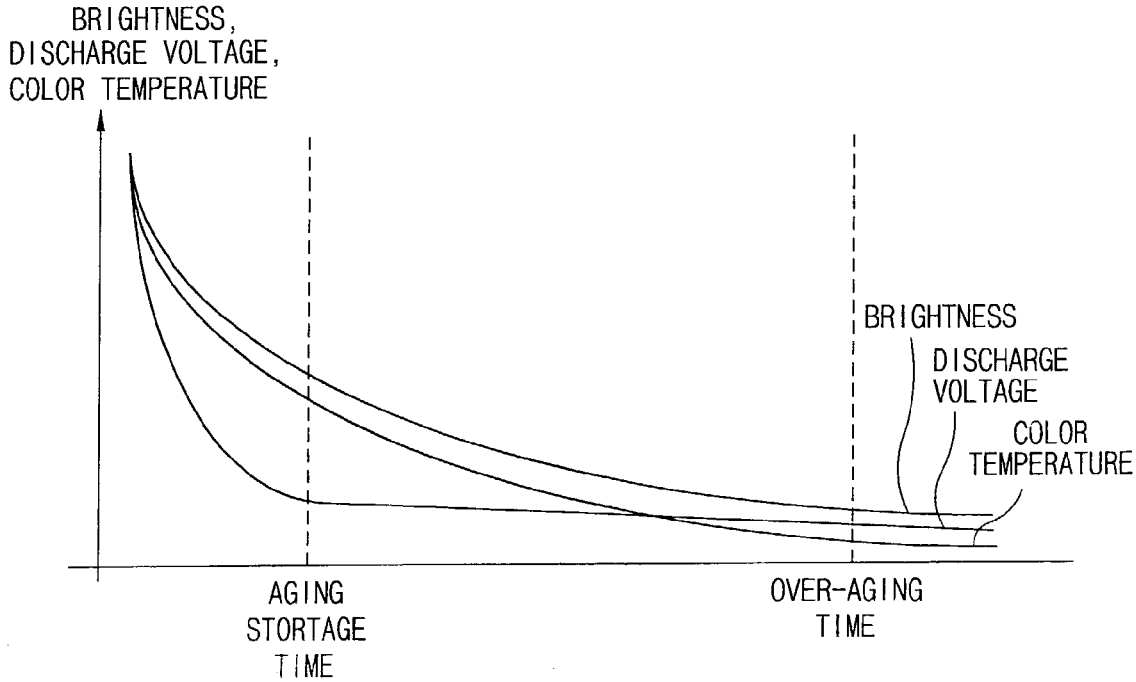
FIG.3 CONVENTIONAL ART
FIG. 3 is a graph showing characteristics of brightness, discharge voltage, and color temperature according to time passage in aging process according to the conventional art.
Figure 4:
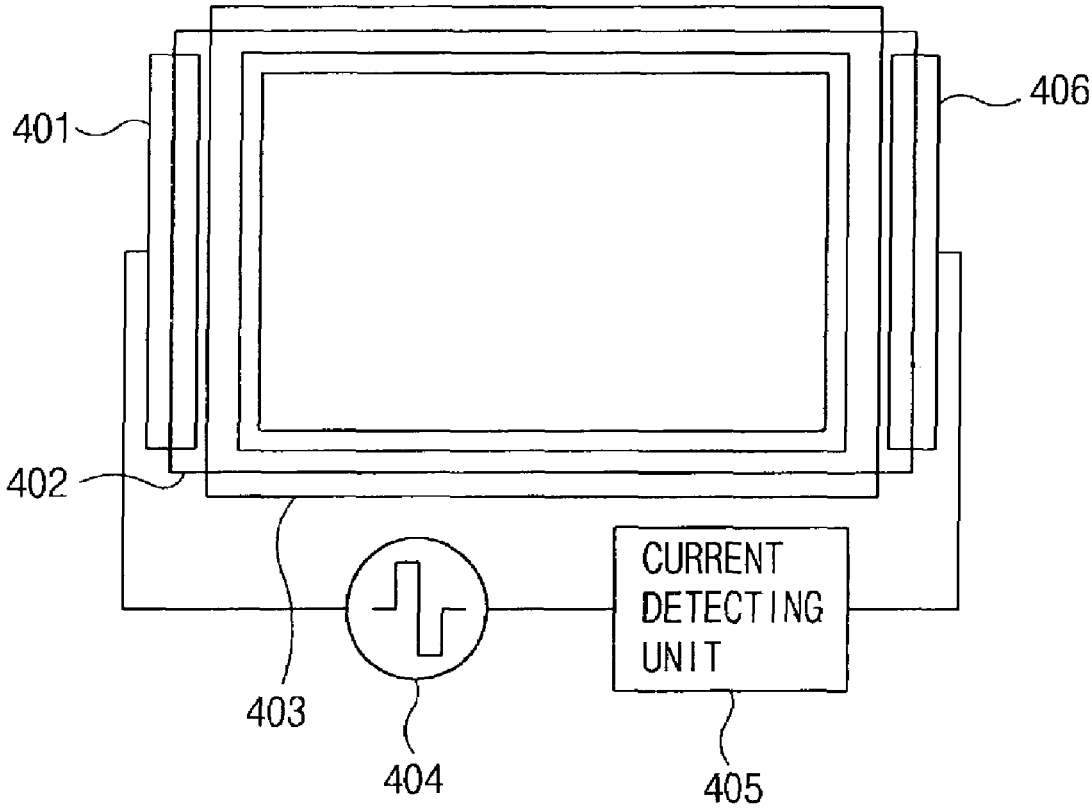
FIG. 4 is a view showing an aging system according to the present invention.

FIG. 4 is a block diagram showing an aging system of the PDP according to the present invention. As shown therein, the aging system comprises: an upper substrate 402 and a lower substrate 403; conductive pads 401 and 406 for electrically connecting the upper substrate 402 and the lower substrate 403; a power supplying unit 404 for supplying electric source to the conductive pads 401 and 406; and a current detecting unit 405 for detecting the electric current flowing between the power supplying unit 404 and the conductive pads 401 and 406.

In the method for aging process using the above aging system, left discharge sustain electrodes on the upper substrate 402 are short-circuited using the conductive pad 401 under room temperature (20~25° C.), right discharge sustain electrodes on the upper substrate 402 are short-circuited using the conductive pad 406, and after that, power source is supplied by connecting the power supplying unit 404 to the both pads to make a discharge, and thereby, the aging process is started.

After that, changes of the current waveform are detected through the current detecting unit 405 with a predetermined time intervals. At that time, the current detecting unit 405 is not for detecting instantaneous current value, but for monitoring movement change of the current waveform.

Figure 5:
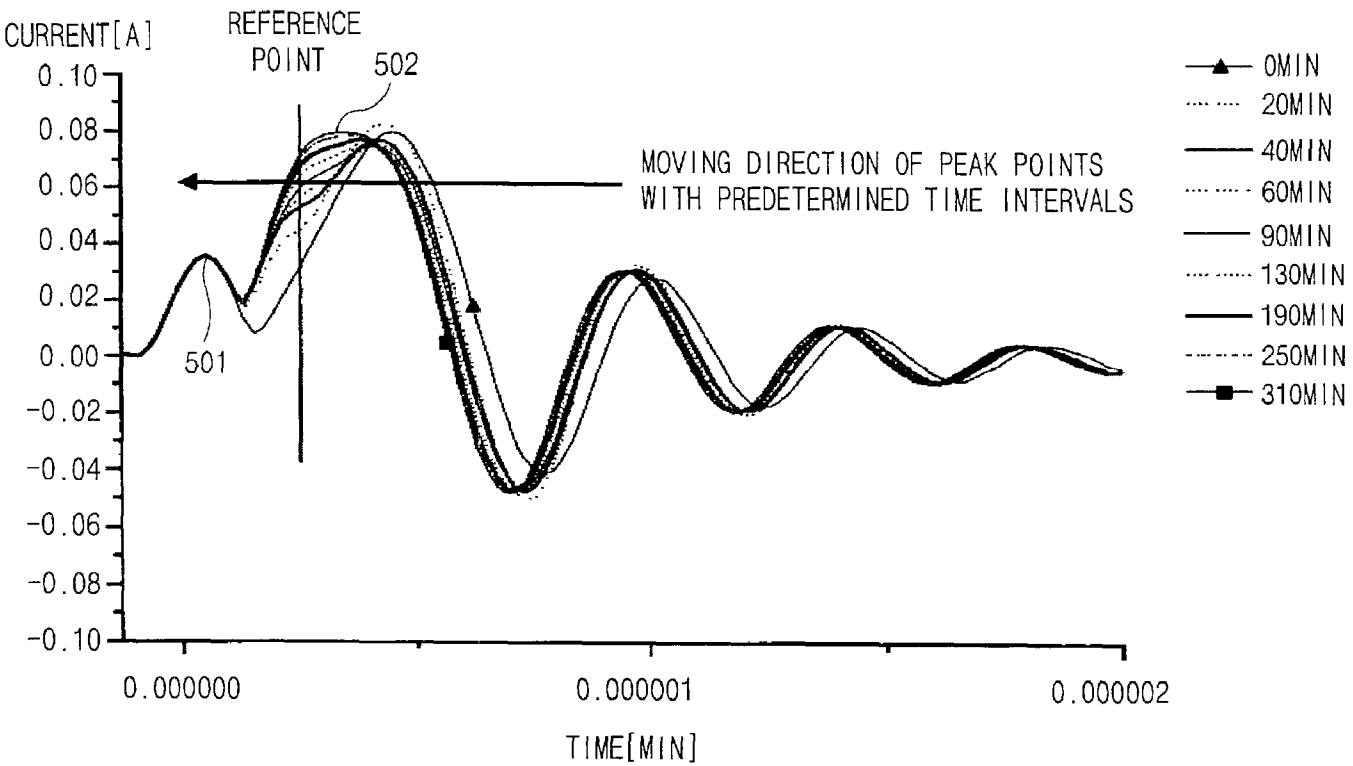
FIG. 5 is a graph showing changes of current waveform detected under room temperature during aging process according to the present invention.

That is, as shown in FIG. 5, when the voltage is applied to the conductive pads 401 and 406 from the power supplying unit 404 and the discharging is generated in aging process, displacement current 501 is generated from the discharge sustain electrode of the panel at early stage, however, discharge current 502 is generated after the displacement current is generated. In addition, as the aging time is elapsed, a time point when a first peak value of the discharge current is shown becomes earlier little by little, and a time point when the time point of first peak value is stabled constantly is determined as the aging ending time (the aging ending time can be determined by the changes of other peak values after second peak value besides the first peak value).

The decision of the aging ending time will be described in more detail as follows.

Figure 6:
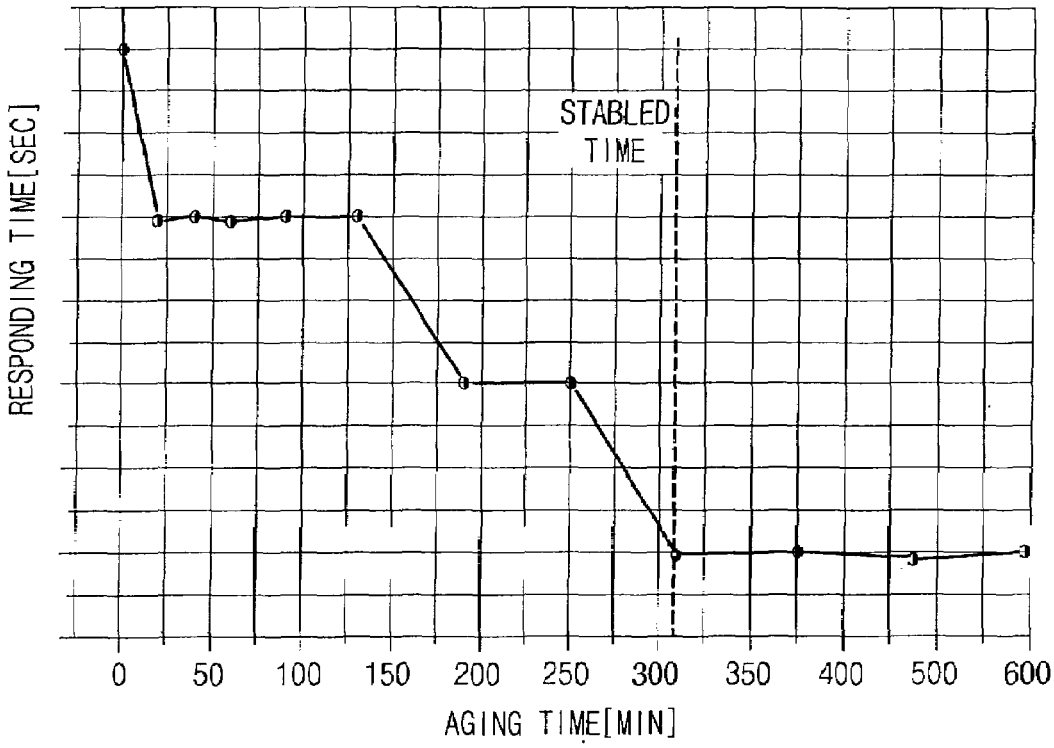
FIG. 6 is a graph showing a responding time of the current for supply voltage supplied to the PDP according to the present invention.
Figure 7:
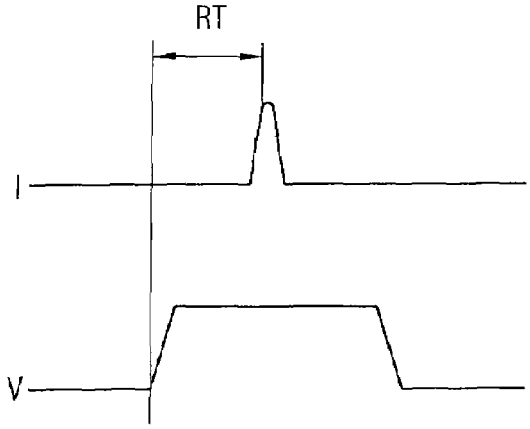
FIG. 7 is a graph showing change of responding time of the current for the supply voltage according to the aging elapsed time under room temperature during aging process according to the present invention.

FIG. 6 is a waveform showing responding time of the current for the supply voltage supplied to the PDP according to the present invention. As shown therein, if the time until the peak value of the discharge current detected in the current detecting unit 405 is reached after applying the voltage by the power supplying unit 404 to the panel is called as the responding time (RT), the aging ending time can be represented as FIG. 7.

That is, after the voltage is applied to the PDP, the responding time until the discharge current reaches to the peak value is reduced as the aging time is elapsed, and after a certain time point, the responding time of the current becomes constant. Therefore, the above certain time point is the aging ending time.

For example, in aging process for a test panel of 7.5 inches under the room temperature (20~25° C.), the time point when the time of first peak value of the discharge current detected during the aging becomes constant is about 5 hours after starting the aging process. That is, the aging is performed under the room temperature (20~25° C.) and the change of the current waveform is monitored, and therefore, the aging ending time is observed as 5 hours from the aging start as shown in FIG. 5. The optimal aging ending time can be determined through the above processes.

Also, the aging ending time can be advanced by changing values of other factors using the above decision method. For example, the case of temperature will be described.

Figure 8:
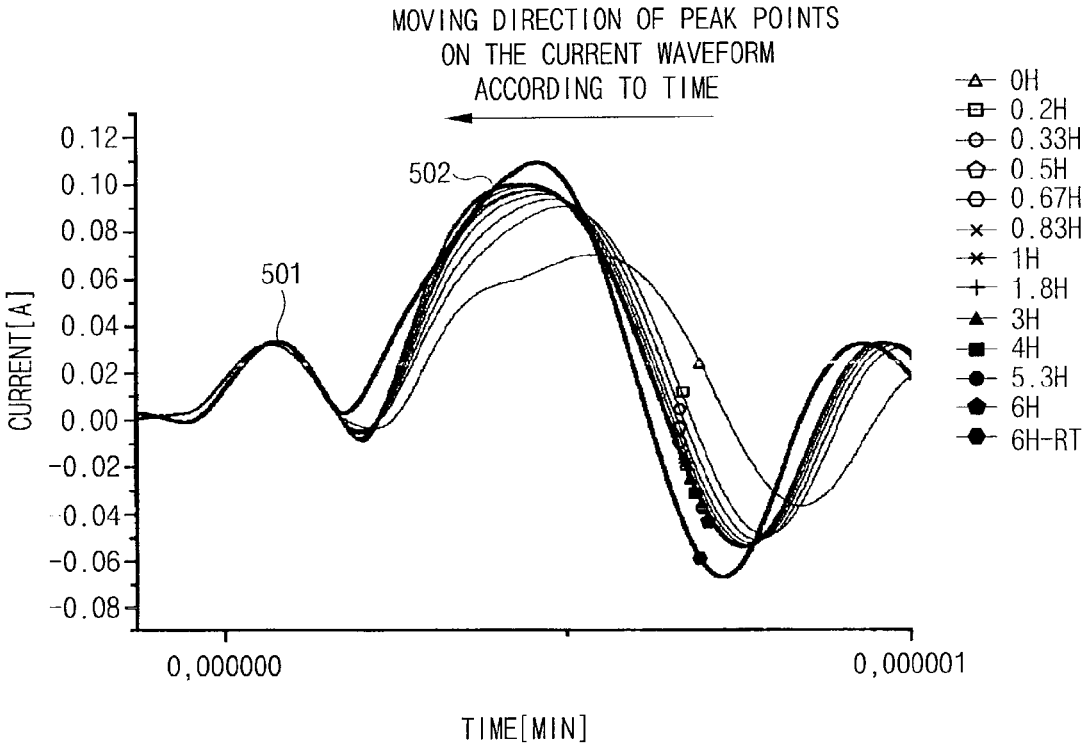
FIG. 8 is a graph showing change of current waveform detected under high temperature during aging process according to the present invention.

FIG. 8 is a graph showing changes of current waveform detected under high temperature in aging process according to the present invention. As shown therein, the method for aging process in the PDP according to the present invention is performed under the temperature of 100~150° C. And the changes of the current waveform are monitored by the current detecting unit 405, and thereby, the aging ending time can be determined.

That is, when the aging is performed under the high temperature of 100~150° C., the current waveform detected from the discharge sustain electrode of the panel shows that the discharge current 502 is generated after the displacement current 501 is generated at early stage as under the room temperature, and the time point where the first peak value of the discharge current is shown is advanced as time goes by. In addition, the time for stabling the change of current waveform is reduced more than that of aging under the room temperature. Therefore, if the panel is discharged under the temperature of 100~150° C., exciting energy of the phosphor is small and the aging time is reduced, and therefore, the deterioration or damage of the phosphor can be minimized.

Figure 9:
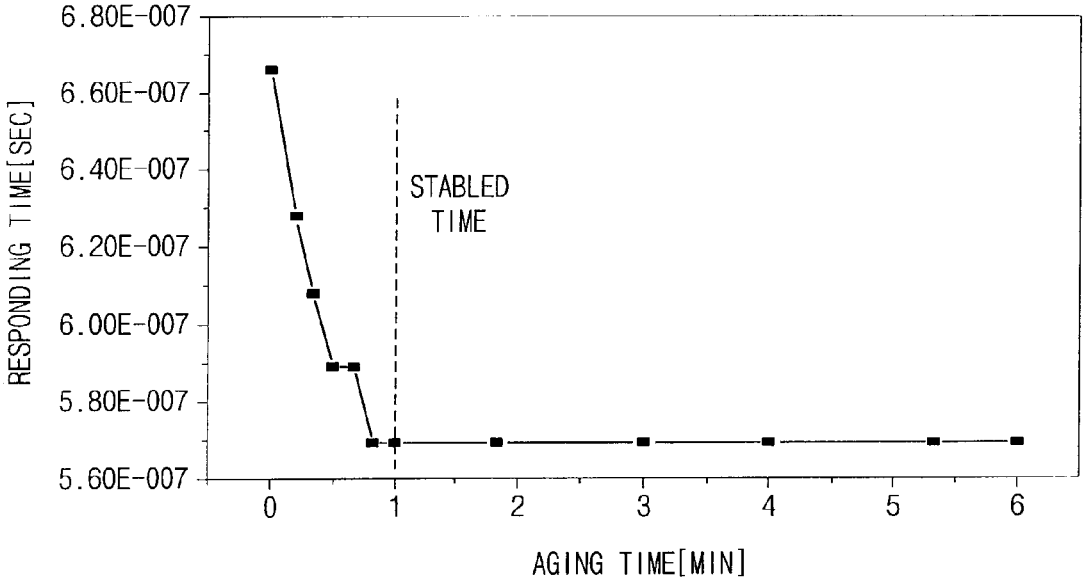
FIG. 9 is a graph showing a change of responding time of the current for the supply voltage in accordance with the aging elapsed time under high temperature during the aging process according to the present invention.

For example, in aging process for a test panel of 7.5 inches under the high temperature (100~150° C.), the aging ending time when the time of showing the first peak time of the discharge current detected in the aging process is stabled constantly is about 1 hour after the aging is started as shown in FIG. 9.

As described above, when the aging is performed under the high temperature, the time point when the time of showing the first peak value of the discharge current is stabled constantly, that is, the aging ending time can be advanced faster than that of the aging process performed under the room temperature.

The accuracy of the method for aging process can be identified through the changes of the discharge voltage and of the brightness.

Figure 10:
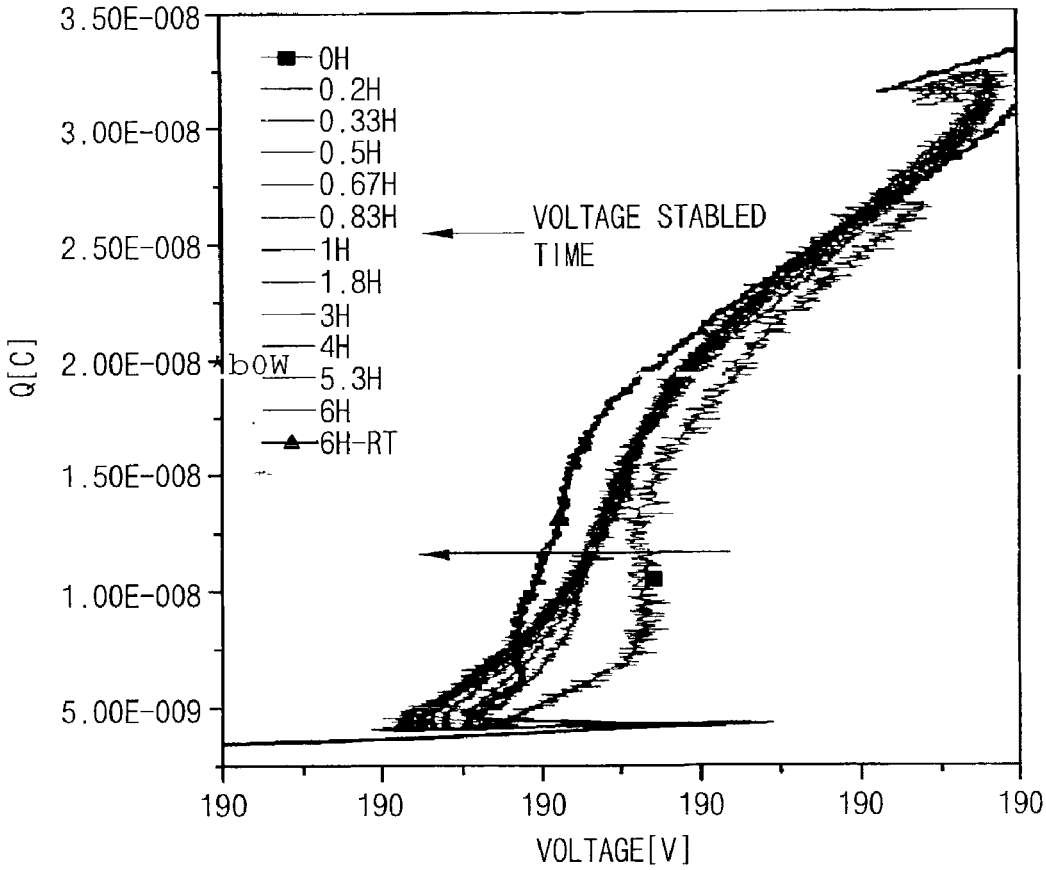
FIG. 10 is a graph showing a change of discharge voltage in accordance with the aging elapsed time under high temperature during the aging process according to the present invention.

FIG. 10 is a graph showing changes of discharge voltage in accordance with the aging elapsed time in aging process of the present invention. As shown therein, as the aging time is elapsed, the discharge voltage ($V_F$) which is able to make the discharging is lowered, and the discharge voltage ($V_F$) is maintained as 195[V]~196[V] after 1 hour has passed from the aging started time. Therefore, when the aging process is performed under the high temperature and the change of discharge current according to the aging elapsed time is monitored, the time point where the first peak value of the current is shown is stabled when about 1 hour is passed since the aging was started as described above, and the discharge voltage ($V_F$) becomes constant. Therefore, it can be known that the aging ending time when the discharge characteristics of the panel is stabled constantly is determined precisely.

Figure 11:
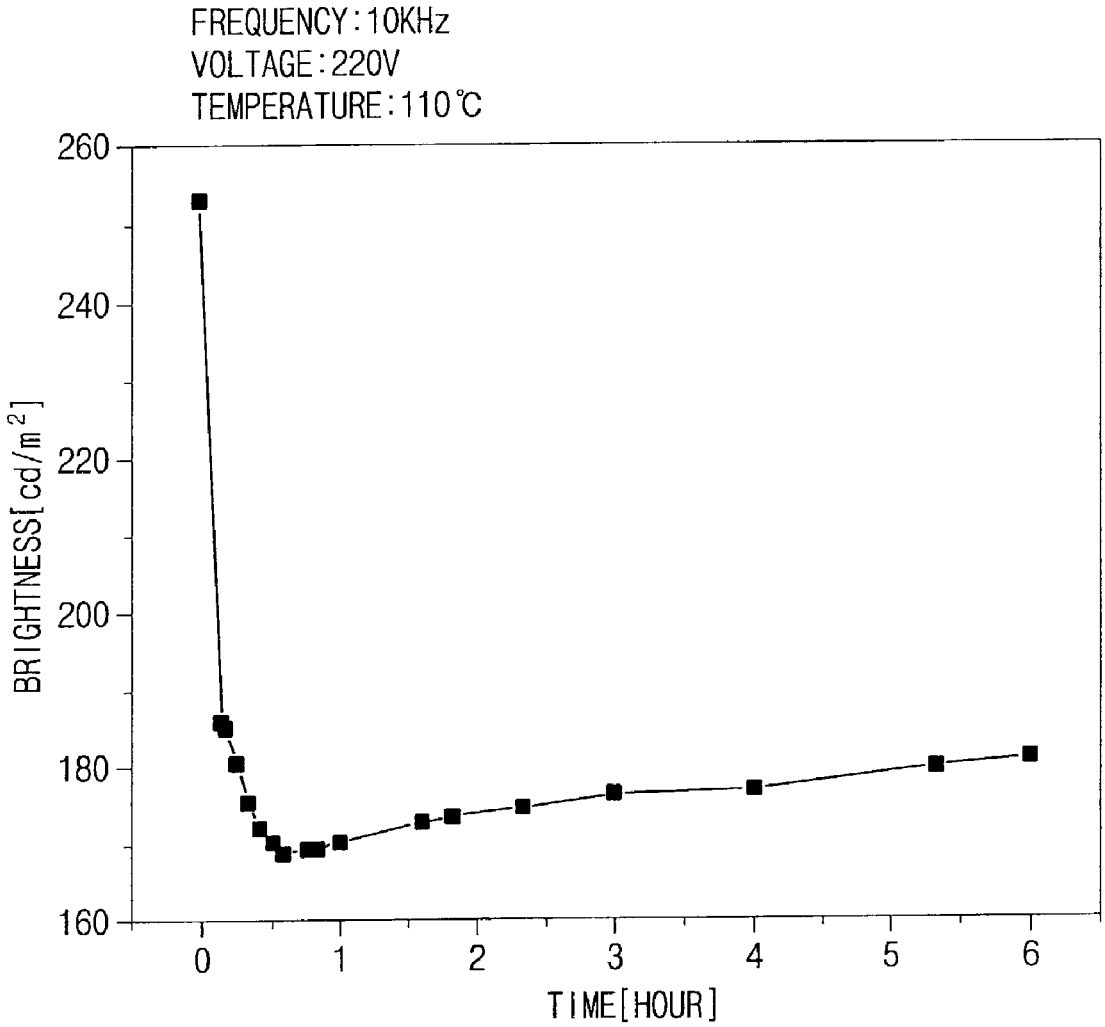
FIG. 11 is a graph showing a brightness change in accordance with the aging elapsed time under high temperature according to the present invention.
Figure 12:
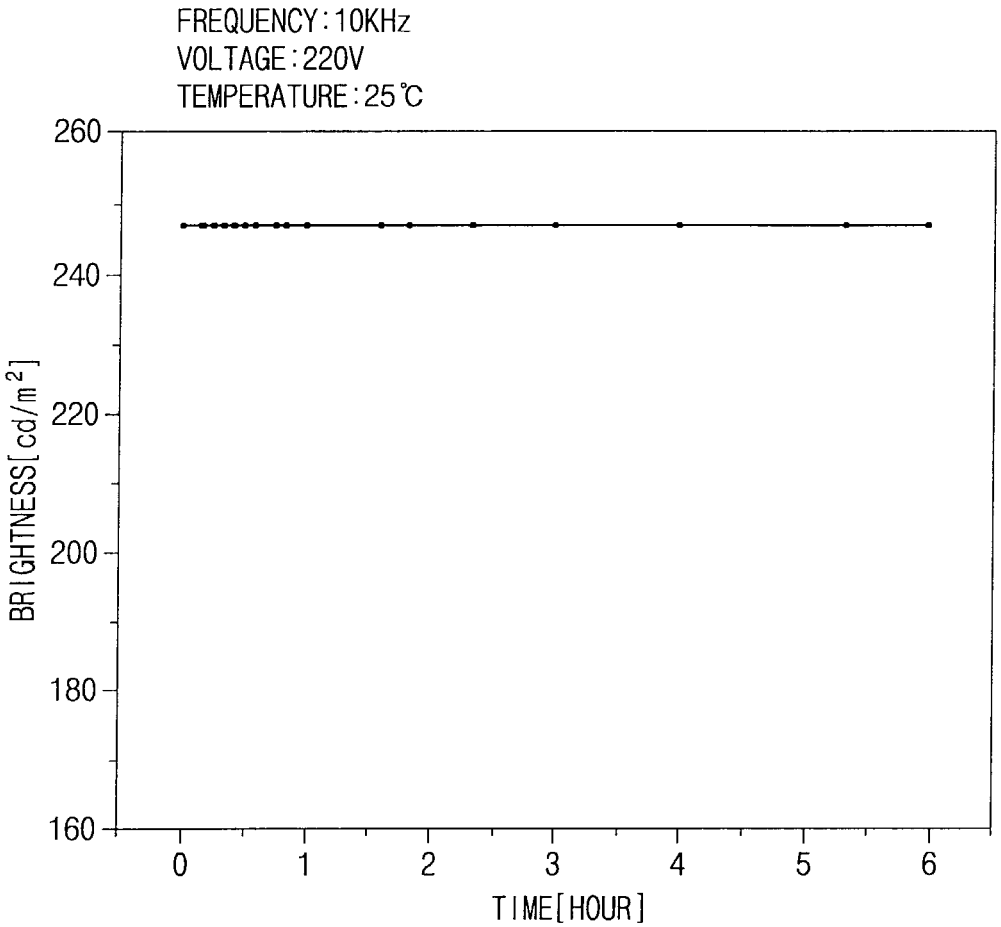
FIG. 12 is a graph showing a brightness change measured under room temperature after the aging process is ended, in aging process according to the present invention.

Also, as shown in FIG. 11, in case of the aging condition, the brightness is rapidly reduced according to changes of the temperature factor when comparing it to the initial brightness before the aging is performed. However, as shown in FIG. 12, when the brightness is re-measured as maintaining the temperature to be the room temperature after the aging is performed, the brightness is maintained constantly, and therefore, the phosphor deterioration according to the temperature is not largely different from the aging condition under the room temperature.

As described above, those who skilled in the art would understand the method for reducing the aging ending time by controlling the frequency (an optimal frequency is found and the aging ending time can be found in the shortest time by monitoring the change of the current waveform as increasing the frequency of supply voltage), the size of supply voltage, and the other factors besides the temperature factor.

As described above, according to the method for aging process in the PDP of the present invention, the change of the current waveform during the aging process is monitored to define the aging ending time precisely, and thereby the problems such that the discharge characteristics of the panel is unstable due to lack of the aging time and the phosphor is deteriorated and the processing tack-time is increased due to the over aging can be solved.

Also, according to the method for aging process in the PDP of the present invention, the aging ending time is defined precisely by monitoring the changes of the current waveform of the panel during aging process, and after that, the aging ending time can be reduced using the factors such as the temperature, the frequency, and size of the supply voltage.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for performing an aging process in a plasma display panel (PDP) comprising the steps of:

starting an aging process by supplying source voltage to a PDP; and defining an aging ending time by monitoring changes of a current waveform applied to the panel, wherein the step of defining the aging ending time comprises the steps of:

checking time points when first peak values of a discharge current discharged from the PDP with a predetermined time interval; and determining a time point as the aging ending time when time points of first peak values of the discharge current are maintained constantly at above time point.

2. The method of claim 1, wherein the step of defining the aging ending time comprises the steps of:

changing temperature during the aging process;

determining an optimal temperature for performing the aging while the temperature is changed; and determining the aging ending time based on changes of the current waveform.

3. The method of claim 2, wherein the optimal temperature is within a range of 100~150° C. as a result of experiment.

4. An aging method for a plasma display panel (PDP), comprising the steps of:

monitoring a change of a current waveform applied to the panel after an aging process is started; and defining a time point where the change of the current waveform is maintained constantly as an ending point of the aging process, wherein the step of defining the ending point of the aging process comprises the steps of:

checking time points when first peak values of a discharge current discharged from the PDP with a predetermined time interval; and determining a time point as the aging ending time when time points of first peak values of the discharge current are maintained constantly at above time point.

5. The method of claim 4, wherein the step of defining the ending point of the aging process comprises the steps of:

changing temperature during the aging process;

determining an optimal temperature for performing the aging while the temperature is changed; and determining the ending point of the aging process based on the change of the current waveform.

6. The method of claim 5, wherein the optimal temperature is within a range of 100~150° C. as a result of experiment.

7. In a fabrication process for a plasma display panel (PDP) comprising the steps of: fabricating an upper substrate and a lower substrate of the PDP, applying a sealant between the upper and lower substrates, attaching the upper and lower substrates by baking the sealant at high temperature; maintaining a discharge area between the upper and lower substrates by connecting an air exhaust hole on the lower substrate and connecting a exhaust pipe on the air exhaust hole, after that, injecting inert gas into the discharge area; and tipping-off the exhaust pipe after the injection is completed, a method for aging the PDP comprising the steps of:

starting the aging by supplying source voltage to the panel; and defining an aging ending time by monitoring changes of a current waveform applied to the panel, wherein the step of defining the aging ending time comprises the steps of:

checking time points when first peak values of a discharge current discharged from the PDP with a predetermined time interval; and determining a time point as the aging ending time when time points of first peak values of the discharge current are maintained constantly at above time point, as checked during the checking step.

8. The method of claim 7, wherein the step of defining the aging ending time comprises:

changing temperature during the aging;

determining an optimal temperature for performing the aging while the temperature is changed; and determining the aging ending time based on the change of the current waveform.

9. The method of claim 8, wherein the optimal temperature is within a range of 100~150° C. as a result of experiment.

10. The method of claim 7, wherein the inert gas is selected from at least one of Ne, Xe and He.

* * * * *